US005296648A

United States Patent [19]

Johnson

[11] Patent Number: 5,296,648

[45] Date of Patent: Mar. 22, 1994

[54] FLAT CABLE

[75] Inventor: John E. Johnson, Huber Heights, Ohio

[73] Assignee: Belden Wire & Cable Company, Richmond, Ind.

[21] Appl. No.: 874,039

[22] Filed: Apr. 27, 1992

[51] Int. Cl.[5] ..... H01B 7/08

[52] U.S. Cl. ..... 174/117 F

[58] Field of Search ..... 174/117 F, 117 FF, 117 R

[56] References Cited

U.S. PATENT DOCUMENTS

| | | | |
|---|---|---|---|
| 3,108,154 | 10/1963 | Cound | 174/117 F |
| 3,219,752 | 11/1965 | Harris | 174/117 F |
| 4,988,835 | 1/1991 | Shah | 174/117 F |

FOREIGN PATENT DOCUMENTS

| | | | |
|---|---|---|---|
| 41097 | 12/1981 | European Pat. Off. | 174/117 F |
| 123417 | 10/1984 | European Pat. Off. | 174/117 F |
| 840863 | 4/1952 | Fed. Rep. of Germany | 174/117 F |
| 1465727 | 5/1964 | Fed. Rep. of Germany | 174/117 F |
| 1913972 | 10/1970 | Fed. Rep. of Germany | 174/117 F |
| 1529809 | 6/1968 | France | 174/117 F |
| 7114720 | 5/1972 | Netherlands | 174/117 F |
| 1390152 | 4/1975 | United Kingdom | 174/117 F |

*Primary Examiner*—Leo P. Picard
*Assistant Examiner*—D. A. Tone
*Attorney, Agent, or Firm*—Laff, Whitesel, Conte & Saret

[57] ABSTRACT

The inventive cable comprises a plurality of axially-spaced flexible metal conductors which are each disposed within a layer of insulation and a jacket. A solid webbing interconnects the jackets, and, preferably, is integral with the jackets. The webbing has a thickness that is substantially less than the minor dimension of the cable, and the webbing and conductors preferably lie in a common plane. A polarity wing is provided that extends a predetermined distance from the jacket of one of the end conductors, and is preferably integral with the jacket. The polarity wing preferably has a thickness that is substantially less than the minor dimension of the cable. The polarity wing and webbing extend diametrically opposite of the end conductor so that the polarity wing lies in the same plane as the conductors and webbing. The polarity wing provides a key-like effect to ensure that the cable is properly meshed with the connector. In this regard, the polarity of the various conductors are preselected depending upon the system requirements so that the polarity can be readily determined based on the relative locations of the conductors.

3 Claims, 1 Drawing Sheet

FLAT CABLE

The present invention relates to electrical cables, and, more particularly, to a flexible flat-type cable that can be used with control systems such as heating, venting, cooling, lighting and computer controlled environmental systems.

BACKGROUND OF THE INVENTION

Various types of cables adapted to provide electrical energy, i.e. power cables, are heretofore known. Such cables may be flexible, semirigid or rigid. It has also been known to construct flat power cables, which increase flexibility. An advantage in using flexible cables is that such cables are easier to install if they are intended to extend through walls, floors and ceilings.

Other types of cables are used in connection with communicating data in computer systems. This is the type of cable which we are concerned with. In view of the wide range of modern applications of computer systems, it often is necessary to install such cables not only through walls, floor, and ceilings, but also through equipment and machinery. Most modern heating, ventilating and air conditioning systems, for example, are computerized and it is necessary to install such cables through plenum areas. The type of cables conventionally used with such systems are round cables, which are difficult to work with because tools are required for making various connections, including an insulation displacement connector (IDC), and because the round cables are difficult to install where there are clearance constraints. Another disadvantage in using round cables is that conductors within the cables must always be color-coded so the identification of each conductor can be determined.

It is an object of this invention to provide a flat cable for use with computer and data control systems.

It is a further object of this invention to provide such a cable that is flat and can effect connectorization without the need for tools.

It is a further object of this invention to provide such a flat cable where prior removal of the outer most jacket is not required for connectorization.

It is further still an object of this invention to provide such a cable that can be used in plenum areas.

SUMMARY OF THE INVENTION

The present invention entails the use of flat cables in connection with control systems, i.e., computer and data control systems and particularly those systems employed in heating, ventilating and air conditioning systems. The inventive flat cable comprises a plurality of axially-spaced flexible metal conductors which are each disposed within a layer of insulation and a jacket. Most or all of the conductors are intended to be used to transfer data. A solid webbing interconnects the jackets, and, preferably, is integral with the jackets. The webbing has a thickness that is substantially less than the minor dimension of the cable (i.e. the diameter of the layer of insulation), and the webbing and conductors preferably lie in a common plane.

In addition, a polarity wing or key is provided that extends a predetermined distance from the jacket. Preferably, the polarity wing, integral with the jacket, extends for the entire length of the multi-conductor cable. This allows the multi-conductor flat cable to be severed at any point and still be properly installed without tools when an appropriate corresponding key connector is used. The polarity wing preferably has a thickness that is substantially less than the minor dimension of the cable. Preferably, the polarity wing and webbing extend diametrically opposite of an end conductor so that the polarity wing lies in the same plane as the webbing. The polarity wing provides a key-like effect to ensure that the cable becomes meshed with the appropriate keyed connector. In this regard, the polarity of the various conductors are preselected depending upon the system requirements so that the polarity can be readily determined based on the relative locations of the conductors.

The phrase, "multi-conductor flat cable" refers to cables having insulated conductors properly spaced a predetermined distance between adjacent conductors within the cable and being covered by an appropriate jacket. The term flat does not refer to the surfaces of the jacket as being planar. My multi-conductor cable has at least two insulated conductors.

Any number of insulated conductors may be incorporated in the invention, but in the preferred embodiment, three conductors are employed. Also, although the dimensions of the various components may also vary depending on the system requirements, such dimensions should comply with any applicable safety standards.

A preferred construction for a three conductor flat cable having a working voltage of 40 V RMS maximum, a working current of 4 amps maximum, maximum conductor resistance at 20° C. of 11 OHMS/1000 Ft. and a capacitance at 1 MHZ between conductors of less than 25 PF/ft is a multi-strand round conductor having a AWG 20 with a diameter of from about 37 mils to about 40 mils and preferably about 38.5±0.5 mils; the thickness of insulation layers is from about 8 to 12 mils and preferably 10±2 mils; the thickness of jackets is approximately 10 to 18 mils and the conductors are axially spaced a distance from their center line of from about 0.145 to 0.165 and preferably 0.156±0.005 inches; the polarity wing extends from the outer surface of the conductor jacket and is spaced from the center-line of the outside or end conductor a distance of at least 0.10 inches and the distance from the outer surface of the conductor jacket to the end of the polarity wing is preferably greater than the web distance between adjacent conductors; and the thickness of the webbing and polarity wing preferably are equal and are preferably from about 15 to about 25 mils.

The above-described cable offers many benefits. For example, because of the structure, an IDC connector having a corresponding key slot can be used and the connection made without the removal of the outer jacket and without the use of tools. The connection is made by piercing through the jacket and insulation with the connector contacts. Because of the polarity wing, and because the polarities of the conductors are preselected, the appropriate contact is always visibly and easily determined. Moreover, the polarity wing also obviates the need to use color coding since the polarities of the conductors are preselected and will be evident based on the relative location of the conductors. Due to the design, it complies with the latest requirements of CMP and can therefore be utilized as a communication cable for air plenum installations. Finally, the flat cable is much more feasible to install through equipment and machinery having clearance constraints.

The present invention and advantages thereof will become more apparent upon consideration of the following detailed description when taken in conjunction with the accompanying drawings.

DETAILED DESCRIPTION OF THE INVENTION

Figure 1:
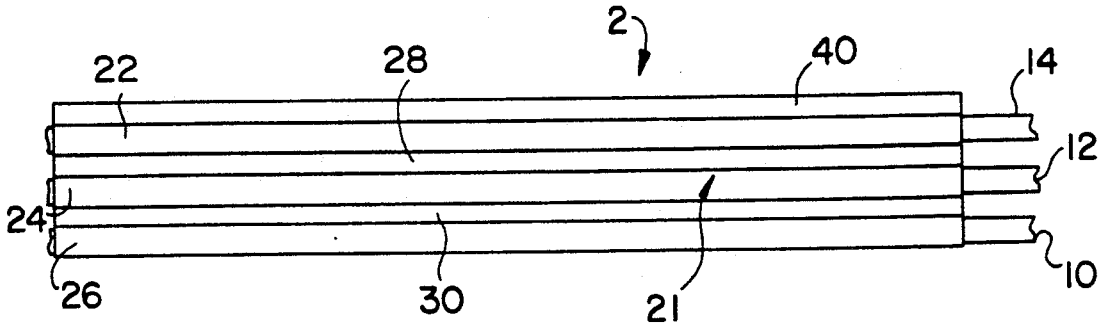
FIG. 1 is a top plan view of a flat cable in accordance with a preferred embodiment of the invention.
Figure 2:
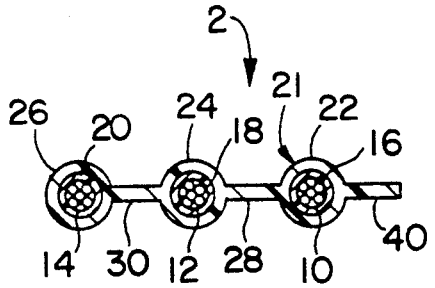
FIG. 2 is a cross section taken along lines 2—2 of FIG. 1.

A flat cable 2 in accordance with the preferred embodiment of the invention comprises three axially-spaced flexible metal conductors 10, 12, 14. Each conductor has a layer of insulation 16, 18 and 20. A jacket 21 overlays the insulation, separates the conductors from each other and provides a key. The jacket provides individual conductor jackets 22, 24, 26, as shown in FIGS. 1 and 2. The axially-spaced conductors 10, 12, 14 lie in a common plane, and the outside conductors 10, 14 are preferably equidistantly located from the central conductor 12, as shown in FIG. 2.

Conductors 10, 12, 14 are constructed of any suitable conductive material such as copper. The conductors are generally stranded conductors having a AWG size of from 25 to 16 and preferably 20. The layers of insulation material 16, 18, and 20 and the jackets 22, 24 and 26 may be constructed of polyvinylchloride, polyethylene, polypropylene or fluorinated ethylene polymer (such as Teflon ®, which is a registered trademark of DuPont) and are preferably flame retardant compositions capable of meeting the UL-910 Steiner flame requirements for CMP approval. However, in order to obtain Underwriters Laboratory approval (Type CMP) for this type of cable, it is necessary for the jacket to be easily separated from the conductor insulation when the jacket is cut by a knife. This is accomplished in many acceptable ways such as when both the jacket and insulation are made of the same or generally the same material, an appropriate release coating or separating tape is placed on the insulation before the jacket is extruded thereover. However, the preferable cable is when the conductor insulation and the jacket are made of different materials.

Jackets 22 and 24 are interconnected and separated by a first web 28, and jackets 24 and 26 are interconnected and separated by a second web 30. Preferably, the jacket 21 is an extruded jacket that is extruded onto the three insulated conductors to provide webs that are integral with the jackets 22, 24, 26. A polarity wing or key 40 extends from the end conductor jacket 22.

For the preferred flat cable, the webs 28 and 30 lie in the same plane and preferably extend from the diametric axis of the respective conductors 10, 12 and 14. The polarity wing 40 preferably has the same thickness as the webs and extends in the same plane as the webs. This construction appears to give the best strength and reliability to the cable.

However, if it is desired, it may be possible to construct the key, conductor spacings and/or webs to have other configurations than that shown and still be within the intended invention.

The polarity wing 40 preferably extends from the jacket 22 diametrically opposite first web 28. The polarity wing 40 provides a key effect to ensure that a proper connection will be made between the cable 2 and an IDC connector or the like. The polarity of the conductors 10, 12, 14 are preselected depending on the system requirements. Preferably, the thicknesses 17 of the first web 28, second web 30, and polarity wing 40 are substantially less than the minor dimension of the cable.

Figure 3:
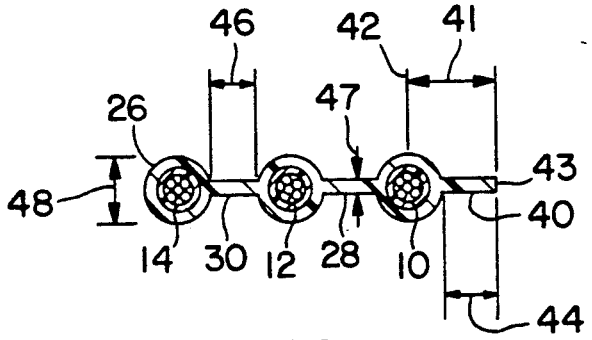
FIG. 3 is a cross-section identical to FIG. 2.

Referring to FIG. 3, the polarity wing 40 extends a distance 41 of at least 0.10 inches measured from the center-line 42 of the end conductor 10 to the polarity wing end 43. The polarity wing distance 44 from the outer surface of the conductor jacket 22 to the polarity wing 43 is preferably greater than the distance 46 between jacketed conductors 24 and 26.

The dimensions of the components and the axial spacing may also vary depending on the design requirements, but should comply with any applicable safety standards. In the preferred embodiment for a three wire cable having a working voltage of 40 V RMS maximum, a working current of 4 amps maximum and a conductor resistance maximum at 20° C. of 11 OHMS/1000 ft the conductor is stranded of copper having a 20 AWG (7×28), a diameter of about 0.039±0.0005 inches, insulated with Teflon having a thickness of about 0.010±0.002 with a total diameter of the insulated conductor being about 0.059±0.002 inches. The jacket surrounding each conductor is a flame resistant polyvinylchloride having an average thickness of 0.015±0.003 inches and thus, the insulated jacketed conductors 22, 24 and 26 have a diameter 48 of about 0.089±0.004 inches.

Preferably, the material selection and cable design in accordance with the invention comply with the latest requirements of Underwriter Laboratory (Type CMP) and it meets the UL 910 Steiner flame requirements, thus allowing for air plenum installation.

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A flexible jacketed flat cable comprising:

a plurality of insulated conductors in spaced relationship to each other, each of said insulated conductors having a conductor and a layer of insulation surrounding said conductor, a separate one-piece jacket surrounding all of said insulated conductors to provide a plurality of spaced jacketed conductors, said one-piece jacket separating said jacketed conductors by a plurality of webs interconnecting each of said jacketed conductors, a thickness of said webs being less than the diameter of the jacketed conductors, and a polarity wing extending from said jacket and said polarity wing being integral with said jacket, said conductors lie in a common plane and are axially spaced, said polarity wing and one of said webs are located diametrically opposite of one of said conductors, said conductors have equal diameters and the thicknesses of said webs and said polarity wing are less than ⅔ of the diameter of the jacketed conductors, the diameter of said conductors is from about 0.037 to 0.040 inches, the conductor insulation has a thickness of approximately 8 to 12 mils, the conductors are axially spaced a distance from their center line of from about 0.145 t 0.165 inches and preferably 0.156±0.005 inches and the jacket has a thickness of approximately 10 to 18 mils; the polarity wing extends from the outer surface of the conductor jacket and is spaced from the center-line of an adjacent end conductor a distance of at least 0.10; inches and the distance from the outer surface of the conductor jacket to the end of the polarity wing is preferably greater than web distance between adjacent conductors; and the thickness of the webs and polarity wing are substantially equal and are from about 15 to about 25 mils;

said layer of insulating material surrounding the conductors and said jacket being constructed of different materials.

2. A flexible jacketed flat cable comprising:

a plurality of insulated conductors in spaced relationship to each other, each of said insulated conductors having a conductor and a layer of insulation surrounding said conductor, a separate one-piece jacket surrounding all of said insulated conductors to provide a plurality of spaced jacketed conductors, said one-piece jacket separating said jacketed conductors by a plurality of webs interconnecting each of said jacketed conductors, the thickness of said webs being less than the diameter of the jacketed conductors, and a polarity wing extending from said jacket and said polarity wing being integral with said jacket, said conductors lie in a common plane and are axially spaced, said polarity wing and one of said webs are located diametrically opposite of one of said conductors, said layers of insulation and said jackets are selected from the group consisting of polyvinylchloride, polyethylene, polypropylene, and fluorinated ethylene polymer, said conductors have equal diameters and the thickness of said webs and said polarity wing are less than $\frac{2}{3}$ of the diameter of the jacketed conductors, the diameter of said conductors is from about 0.037 to 0.040 inches, the conductor insulation has a thickness of approximately 8 to 12 mils, the jacket has a thickness of approximately 10 to 18 mils, and the conductors are axially spaced a distance from their center line of from about 0.145 to 0.165 inches and preferably 0.156±0.005 inches; the polarity wing extends from the outer surface of the end jacketed conductor and is spaced from the center-line of the end conductor a distance of at least 0.10 inches and a distance from the outer surface of the end jacketed conductor to the end of the polarity wing is preferably greater than a distance between adjacent conductors; and the thickness of the webs and polarity wing preferably are substantially equal and are from about 15 to about 25 mils said layer of insulating material surrounding the conductors and said jacket being constructed of different materials.

3. A flexible flat jacketed cable comprising:

three axially-spaced flexible copper insulated conductors each having the same diameter, each of said insulated conductors having a conductor and a layer of insulation surrounding said conductor, a separate one-piece jacket surrounding all of said insulated conductors to provide a plurality of spaced jacketed conductors, a common jacket around each insulated conductor, said jacket being strippable from said insulated conductors, said layer of insulation surrounding said conductors and said jacket being constructed of a material selected from the group consisting of polyethylene, polypropylene, polyvinylchloride and fluorinated ethylene polymers, said conductors lying in a common plane thereby defining a middle jacketed conductor and a pair of end jacketed conductors, said layer of insulation surrounding said conductors and said jacket being constructed of different materials;

first and second solid webs lying in a common plane and having a thickness that is less than the $\frac{2}{3}$ of the diameter of the jacketed conductors, said first web being integral with and interconnecting the jacket of one of said end jacketed conductors, and said middle jacketed conductor and said second web being integral with and interconnecting the jacket of said middle jacketed conductor and the other of said end jacketed conductors, said first and second webs being located diametrically opposite of said middle jacketed conductor; and a polarity wing lying in the web plane, extending outwardly from said one of said end jacketed conductors and being integral with the jacket of said one end jacketed conductor, said polarity wing and said first web being located diametrically opposite of said one end jacketed conductor.

* * * * *